US005140748A

United States Patent [19]

Kandpal

[11] Patent Number: 5,140,748

[45] Date of Patent: Aug. 25, 1992

[54] METHOD OF MANUFACTURING PLATE SUCTION VALVE

[75] Inventor: Tara C. Kandpal, Tecumseh, Mich.

[73] Assignee: Tecumseh Products Company, Tecumseh, Mich.

[21] Appl. No.: 744,080

[22] Filed: Aug. 12, 1991

[51] Int. Cl.[5] ..... F04B 39/10

[52] U.S. Cl. ..... 29/890.13; 29/890.124; 137/855; 418/270

[58] Field of Search ..... 29/890.13, 890.132, 29/890.124, 428; 137/852, 855, 859; 418/270

[56] References Cited

U.S. PATENT DOCUMENTS

| | | | |
|---|---|---|---|
| 1,768,830 | 7/1930 | Densereau et al. . | |
| 2,899,981 | 8/1959 | Binks | 138/46 |
| 2,908,287 | 10/1959 | Augustin | 137/525 |
| 3,568,712 | 3/1971 | Rinehart | 137/855 |
| 3,998,571 | 12/1976 | Falke | 137/855 |
| 4,193,424 | 3/1980 | Hiabal | 137/855 |
| 4,257,458 | 3/1981 | Kondo et al. | 137/855 |
| 4,406,590 | 9/1983 | Kessler | 29/888.02 |
| 4,532,685 | 8/1985 | Itoh et al. | 29/888.02 |
| 4,642,037 | 2/1987 | Fritchman | 137/855 |
| 4,770,058 | 9/1988 | Lilie et al. | 29/888.02 |
| 4,879,976 | 11/1989 | Boyesen | 137/855 |
| 5,035,050 | 7/1991 | Cowen | 29/888.02 |
| 5,062,779 | 11/1991 | DaCosta | 137/855 |

*Primary Examiner*—Irene Cuda
*Attorney, Agent, or Firm*—Baker & Daniels

[57] ABSTRACT

A method of assembling a reciprocating piston hermetic compressor including a two piece suction valve capable of being deburred by abrasive material. The reexpansion volume between the valve leaf and valve spacer is reduced to a minimum since the clearance between the valve leaf and valve spacer is reduced by the fabrication method. The valve leaf may be made of a different material than the valve spacer using the same or a different stamping tool.

20 Claims, 6 Drawing Sheets

METHOD OF MANUFACTURING PLATE SUCTION VALVE

BACKGROUND OF THE INVENTION

The present invention relates generally to reciprocating piston compressors for compressing fluid and more particularly to such compressors having a cantilevered suction leaf valve.

In a typical reciprocating piston compressor, a cylinder is defined by a compressor crankcase and a piston reciprocates within the cylinder to compress gaseous refrigerant therein. In a compressor to which the present invention pertains, a valve plate assembly is disposed immediate the top surface of the crankcase and a cylinder head mounted thereto. The valve plate assembly includes a suction valve operable to admit fluid into the cylinder during the suction stroke of the compressor and a discharge valve operable to exhaust fluid into a discharge space defined by the cylinder head during the discharge stroke of the compressor.

With respect to the aforementioned valve plate assembly, a valve plate covers the cylinder and includes a suction inlet port extending therethrough to provide fluid communication between the cylinder and a suction pressure chamber in the cylinder head. A cantilevered suction leaf valve also known as a "flapper" valve is mounted adjacent the cylinder facing side of the face valve plate. An unattached end of the valve is in registry with the suction inlet port of the valve plate. During the compression stroke of the compressor, the unattached end is forced by pressure to sealingly cover the suction inlet port. During the intake stroke of the compressor, the unattached end is forced away from the valve plate by fluid being drawn through the suction inlet port.

Currently, suction valves are formed of very thin metal so the flapper can flex open and closed against the valve plate.

In the past, suction leaf valves were formed by stamping out a narrow slot between the flapper portion and the surrounding structure in a piece of valve steel. The width of the slot was controlled by the tooling of the stamping machinery. A problem with the narrow slot concerns the volume of gas that can be contained within the slot between the piston and valve plate in the compressor assembly. This volume, commonly called reexpansion volume, reduces the efficiency of the compressor since the fluid within the volume is repeatedly being compressed and expanded without producing any benefit. The narrower the slot is between the leaf valve and surrounding structure the smaller the reexpansion volume.

During construction of the suction leaf valve, the leaf valve undergoes a process known as "deburring". Deburring is a process of removing the sharp metal or burrs from the edge of stamped pieces. During the deburring, the piece to be deburred is placed into a tumbler along with abrasive material. The tumbler is rotated to allow the abrasive to remove the sharp edges from the metal valve. A particular problem with these types of valves is that the tumbling media or abrasive cannot always reach into the entire narrow valve slot. This prevents the edges at the slot from being deburred.

Further, if the valve edges within the valve slot are not properly deburred, the valve life is considerably shortened.

Another potential problem is that abrasive material wedged between the valve leaf and spacer may remain there during compressor assembly. During compressor operation the abrasive material may interfere with proper valve action and reduce valve life. Also the material may become dislodged within the compressor and cause internal damage.

The present invention is directed to overcoming the aforementioned problems associated with reciprocating piston compressors having cantilevered suction leaf valves.

SUMMARY OF THE INVENTION

The present invention overcomes the problems and disadvantages of the above-described prior art reciprocating piston compressors by providing an improved suction valve comprising a two piece valve assembly that is more efficient and easier to manufacture. More specifically, the present invention provides a two piece suction valve comprising a valve spacer and separate valve leaf or flapper wherein the two parts are separately stamped out of the same or separate stamping strips.

The separate valve leaf and spacer of the present invention die stamp cut from metal strips, increase the efficiency of the compressor by decreasing the space between the valve leaf and spacer. This is because the entire leaf is stamped out by means of a die having an outer perimeter that defines both the outer perimeter of the valve leaf and the opening in the spaces that surrounds the valve leaf. This narrower space between the spacer and valve leaf decreases the reexpansion volume of the compressor.

By separately making the valve leaf and spacer, different construction materials may be used. The present invention does not limit the valve spacer to be made out of the same material as the valve leaf. Reduced cost of the valve is possible since the valve spacer does not have to be fabricated out of expensive valve quality steel as does the valve leaf.

Deburring of the valve leaf and spacer of the present invention also is improved by deburring the leaf and spacer separately. The abrasive deburring media cannot get caught or trapped between the leaf and spacer since they are not attached during deburring. A better and smoother finish on the valve leaf is possible since the entire inside and outside edge is available to action by the abrasive material.

An added benefit is that stamping tool life is extended since the width of the stamping tool is increased. In the prior designs, the stamping tool had to stamp a slot that was very narrow. Any wear on the narrow tool used to stamp the slot would cause failure of the tool or an incomplete slot in the valve. The forms of the present invention allow the stamping tool to be much wider, therefore preventing premature tool failure.

An advantage of the reciprocating piston compressor of the present invention is increased efficiency due to an accurate controlling of the valve stamping process.

An advantage of the reciprocating piston compressor of the present invention is increased reliability since the edges of the suction valve possess a better finish.

An advantage of the reciprocating piston compressor of the present invention is lower manufacturing cost since the improved valve spacer will not have to be constructed out of valve quality steel.

The invention, in one form thereof, provides a method for making a valve assembly of a reciprocating piston compressor comprising the steps of attaching a valve leaf to a valve plate and crankcase cylinder assembly and attaching a separate valve spacer to the valve plate and crankcase cylinder assembly, wherein the valve spacer at least partially encircles the valve leaf. The valve plate is fastened to the compressor crankcase such that the valve spacer and valve leaf are disposed between the valve plate and crankcase. The fabrication of the valve spacer and separate valve leaf preferably are accomplished by die stamp cutting at least one strip of metal. The valve leaf and spacer may both be stamped out of the same spring steel metal strip or may be stamped out of separate metal strips. The valve spacer and valve leaf may be stamped using separate stamping tools or the same stamping tool.

In one aspect of the previously described form of the invention, the valve spacer and valve leaf may be die stamp cut from the same piece of metal at the same time where the valve leaf is die stamp cut from an interior area of the spacer. Generally contiguous notches formed in the spacer and leaf permit proper locating of the valve leaf within valve spacer during assembly.

In accord with another aspect of the invention, the deburring process of tumbling the valve leaf and valve spacers with an abrasive material to deburr the edges is provided. The deburring of the parts may be together or deburring may be conducted separately upon the valve leaf and valve spacers. The tumbling reduces the outer dimensions of the valve leaf while tumbling of the valve spacers allows enlargement of the encircling edge for the required clearance within the valve spacer.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
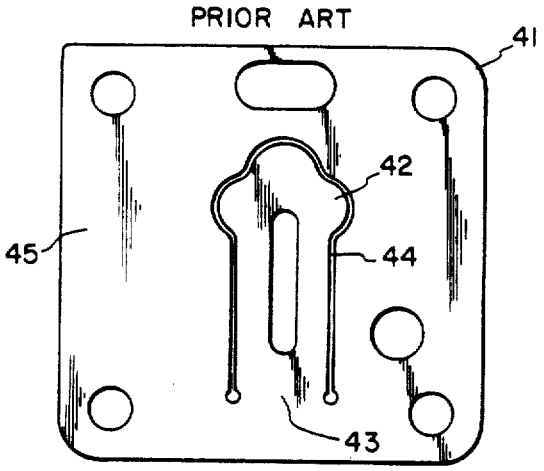
FIG. 1 is a plan view of a suction leaf plate of the prior art.

Corresponding reference characters indicate corresponding parts throughout the several views. The exemplifications set out herein illustrate a preferred embodiment of the invention, in one form thereof, and such exemplifications are not to be construed as limiting the scope of the invention in any manner.

DESCRIPTION OF THE PREFERRED EMBODIMENT

As shown by FIG. 1, a typical prior art valve leaf and spacer plate 41 is constructed in one piece. This prior art valve plate 41 is die stamp cut to form a cantilevered suction leaf valve 42 having an attached end 43 connecting it to spacer portion 45. The stamp cut slot 44 for cantilevered suction leaf valve 42 creates a problem during manufacture of the valve assembly 40 (FIG. 5), particularly during deburring.

Figure 7:
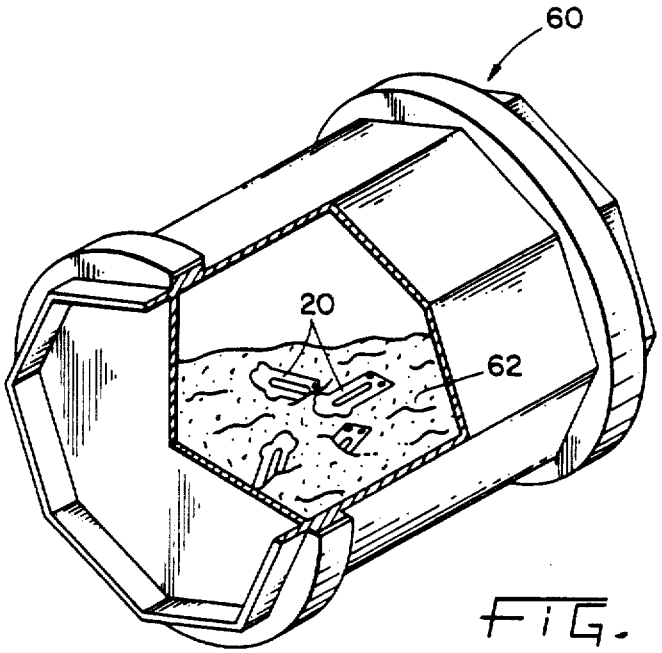
FIG. 7 is a perspective view of a deburring tumbler shown deburring the suction valve leaf of one of the embodiments of the present invention.

Deburring is a process of removing the sharp metal edges along the cutout portions of the valve plate 41 by placing the valve plate 41 within a tumbler 60 much like that shown in FIG. 7. Within tumbler 60, in addition to the valve plates, would be placed abrasive material 62 to wear down the sharp edges on valve plate 41. A problem encountered with this method is that abrasive material 62 can not enter cutout slot 44 and provide deburring to the edges of the cutout slot. Without adequate deburring of the slot edges, reliability and life of the valve is considerably reduced.

The disadvantage with slot 44 is that it increases the reexpansion volume, thereby lowering the compressor efficiency.

Figure 2:
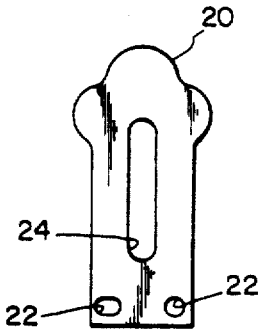
FIG. 2 is a plan view of an embodiment of the suction valve plate of the present invention.
Figure 3:
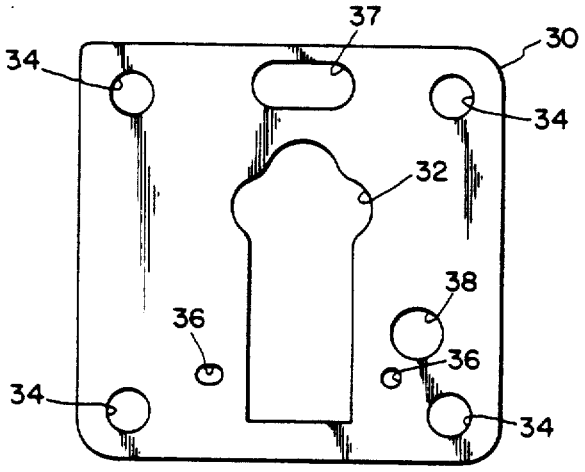
FIG. 3 is a plan view of an embodiment of the valve leaf plate spacer of the present invention.
Figure 8:
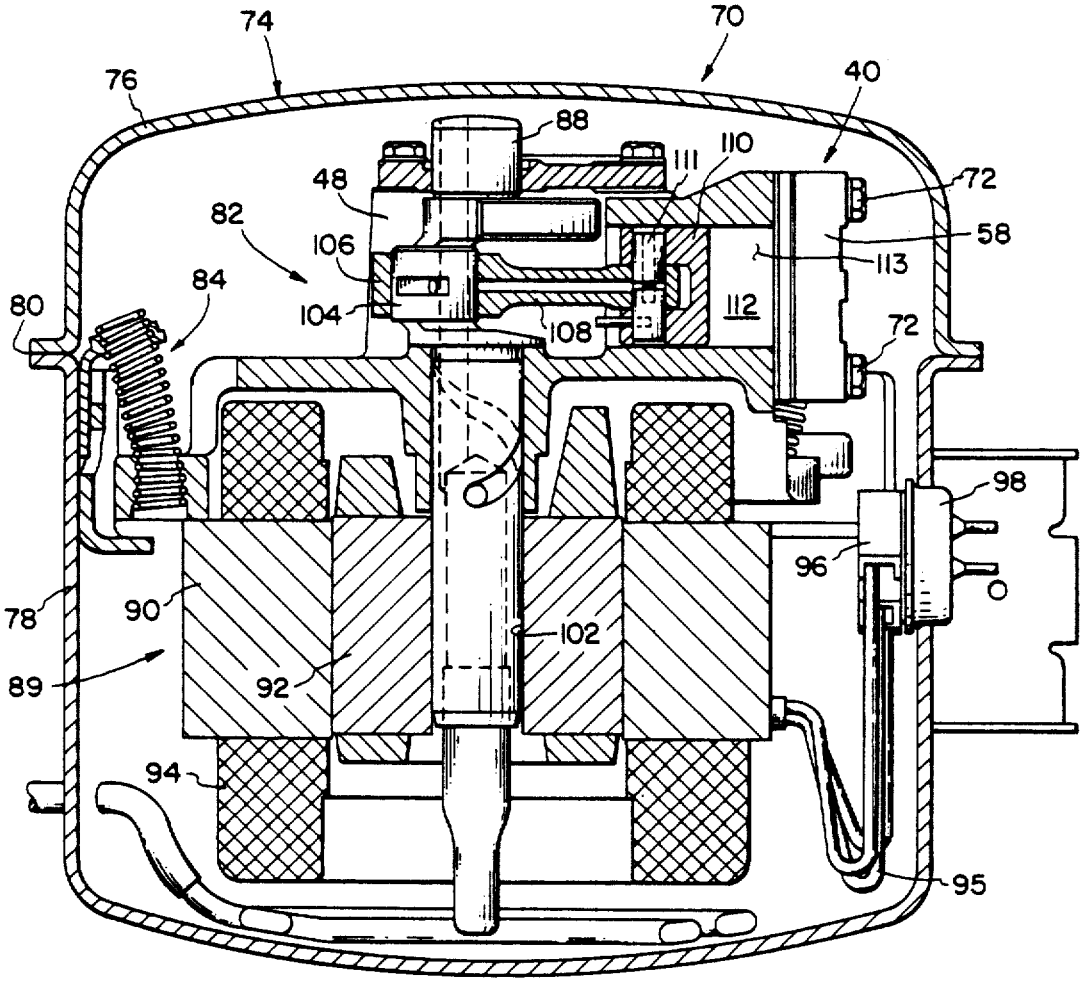
FIG. 8 is a sectional view of the compressor of the present invention.
Figure 9:
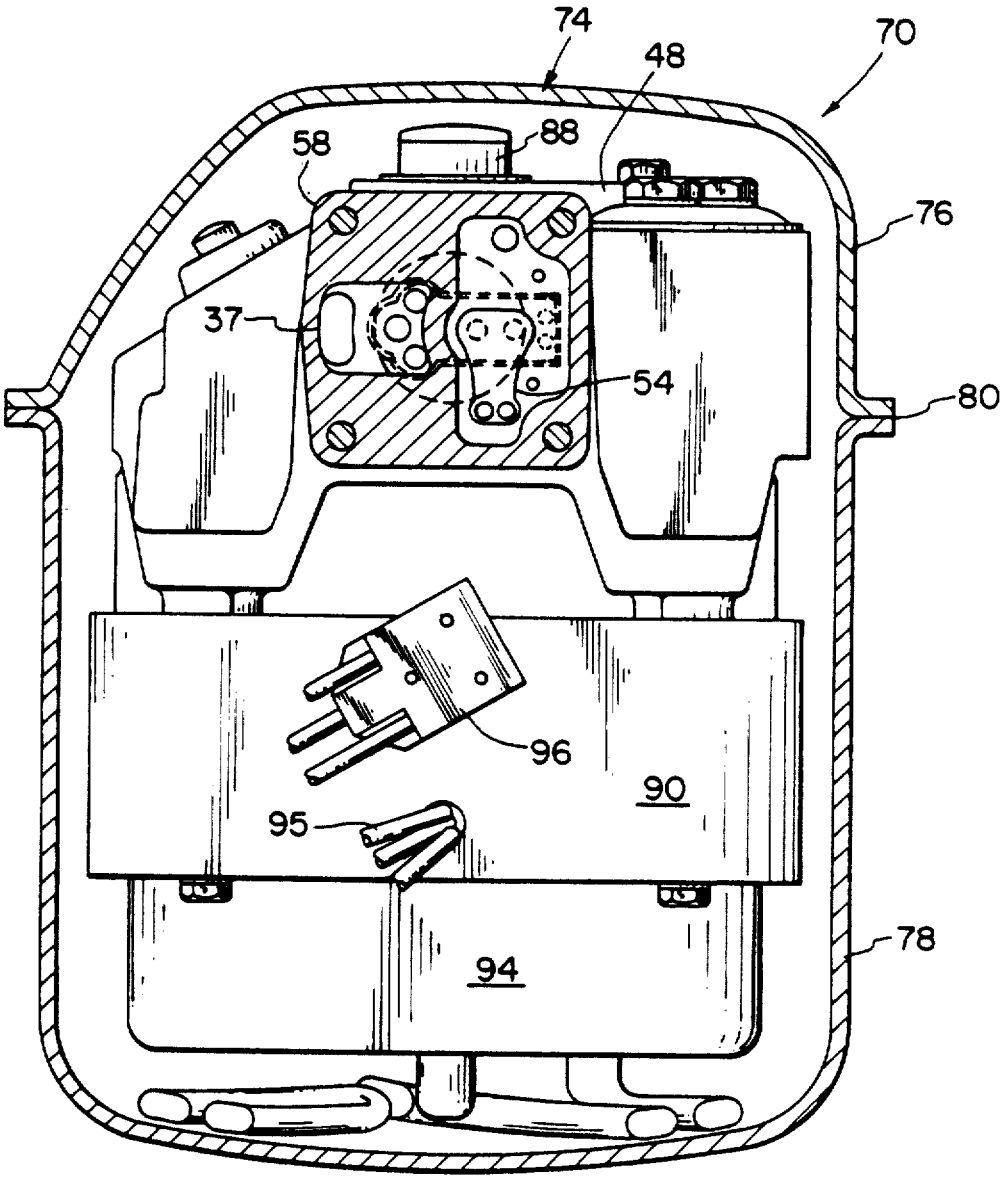
FIG. 9 is a cutaway elevational view of the compressor of the present invention.

In an embodiment of the invention as shown in the drawings, and in particular by referring to FIGS. 2 and 3, a valve leaf 20 and valve leaf spacer 30 are shown. Valve leaf 20 and valve leaf spacer 30 are specifically constructed for use as the suction valve within a valve assembly 40 in a hermetic compressor 70 as shown in FIGS. 8 and 9. Valve leaf 20 preferably has two locating holes 22 for use in connecting valve leaf 20 within valve assembly 40. A slot 24 in valve leaf 20 allows for greater flexing movement during compressor operation and also allows discharge gases from the compressor to pass through. Valve leaf 20 is preferably constructed out of standard valve quality steel.

Valve leaf spacer 30 includes an encircling edge such as centered valve opening 32 which substantially conforms to the shape of valve leaf 20 but is slightly larger. Upon assembly of valve assembly 40 (FIG. 5), valve leaf 20 is disposed within valve opening 32. Valve spacer 30 also includes a plurality of bolt holes 34 for attachment in valve assembly 40. Along the sides of valve opening 32 are locating holes 36. A suction gas inlet 37 and a discharge gas outlet 38 are included in spacer 30.

Figure 4:
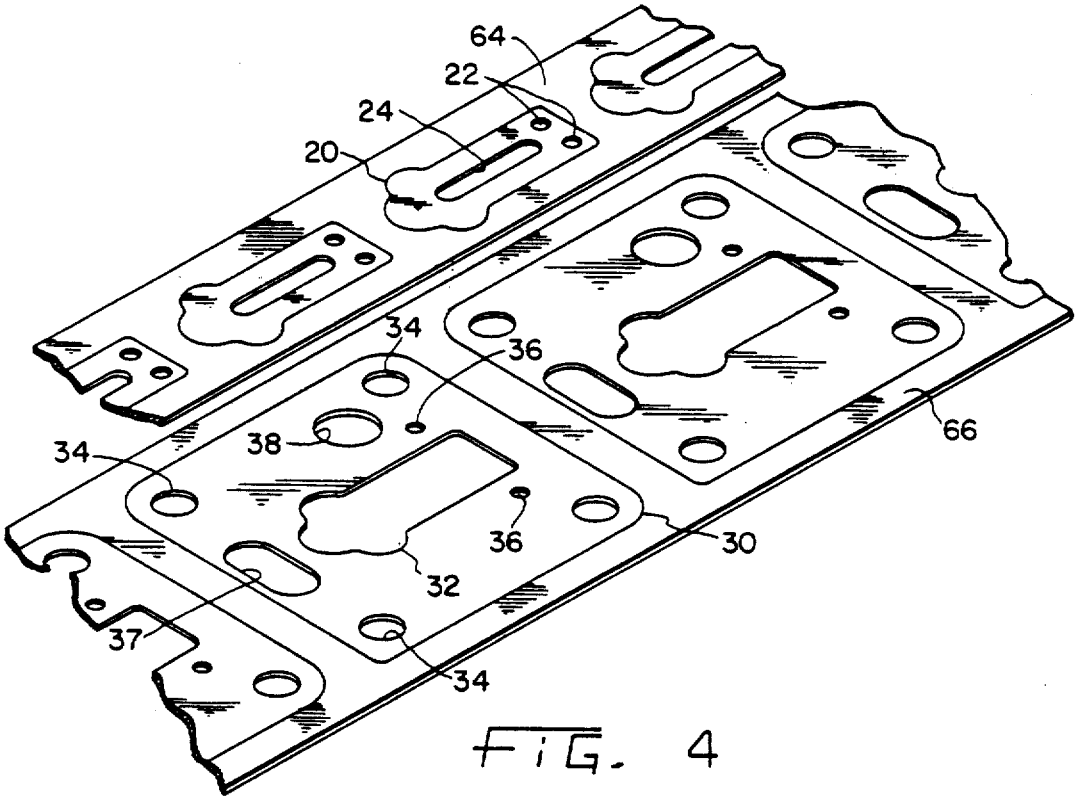
FIG. 4 is a perspective view of the stamping strips used to manufacture embodiments of the present invention.

In accordance with the principles of one embodiment of the present invention, the valve leaf 20 and valve leaf spacer 30 are manufactured by conventional die stamp cutting but from separate sheets or strips as illustrated in FIG. 4. A strip of valve quality steel 64 is used to produce the valve leafs 20 while a strip of standard steel 66 is used for die stamping the valve leaf spacer 30. Valves 20 and spacers 30 are stamped out of strips 64 and 66 in a standard fashion.

An advantage of fabricating the valve leaf 20 and spacer 30 separately is that it permits different materials to be used. One is not limited to only one type of steel for both the valve leaf 20 and spacer 30. It is more economical and inexpensive to fabricate only the valve leaf 20 out of valve quality steel, and the valve spacer 30 out of ordinary steel such as 1010 or 1020.

The stamping tooling used has a longer life than that used to fabricate prior art valves since the stamping tool can be made thicker. The prior tooling had to be thin enough to stamp out narrow slot 44. This made the tooling very susceptible to failure since the thinner tooling is weaker and has a shorter life. After stamping, the parts are deburred.

The valve leaf 20 and valve leaf spacer 30 are placed in a tumbler such as the one shown in FIG. 7 along with abrasive material 62 to deburr any sharp edges and produce the required clearance between the valve leaf 20 and valve hole 32 in the valve leaf spacer 30 by wearing away the edge.

A clearance of approximately 0.005 of an inch between the valve leaf 20 and spacer 30 is preferred for proper operation of the valve assembly 40. This clearance is wide enough to permit movement of valve leaf 20, but is much narrower than slot 44 in the prior art design (FIG. 1).

By having separate valve leafs 20 and valve spacers 30 different degrees of deburring are possible. Depending upon the material of the leafs 20 and spacer 30, the parts may need to be subjected to deburring for different lengths of time in order to meet the required clearances. After undergoing deburring the parts are ready to be assembled.

Figure 6:
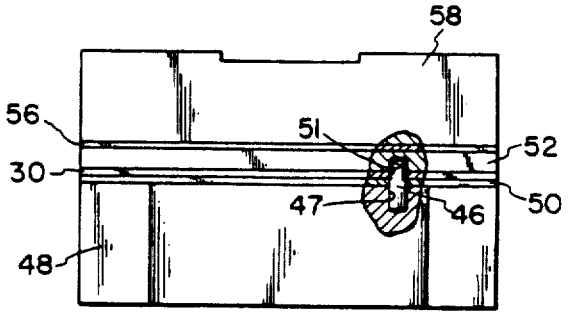
FIG. 6 is an elevational view of the valve plate assembly to which the present invention pertains.
Figure 5:
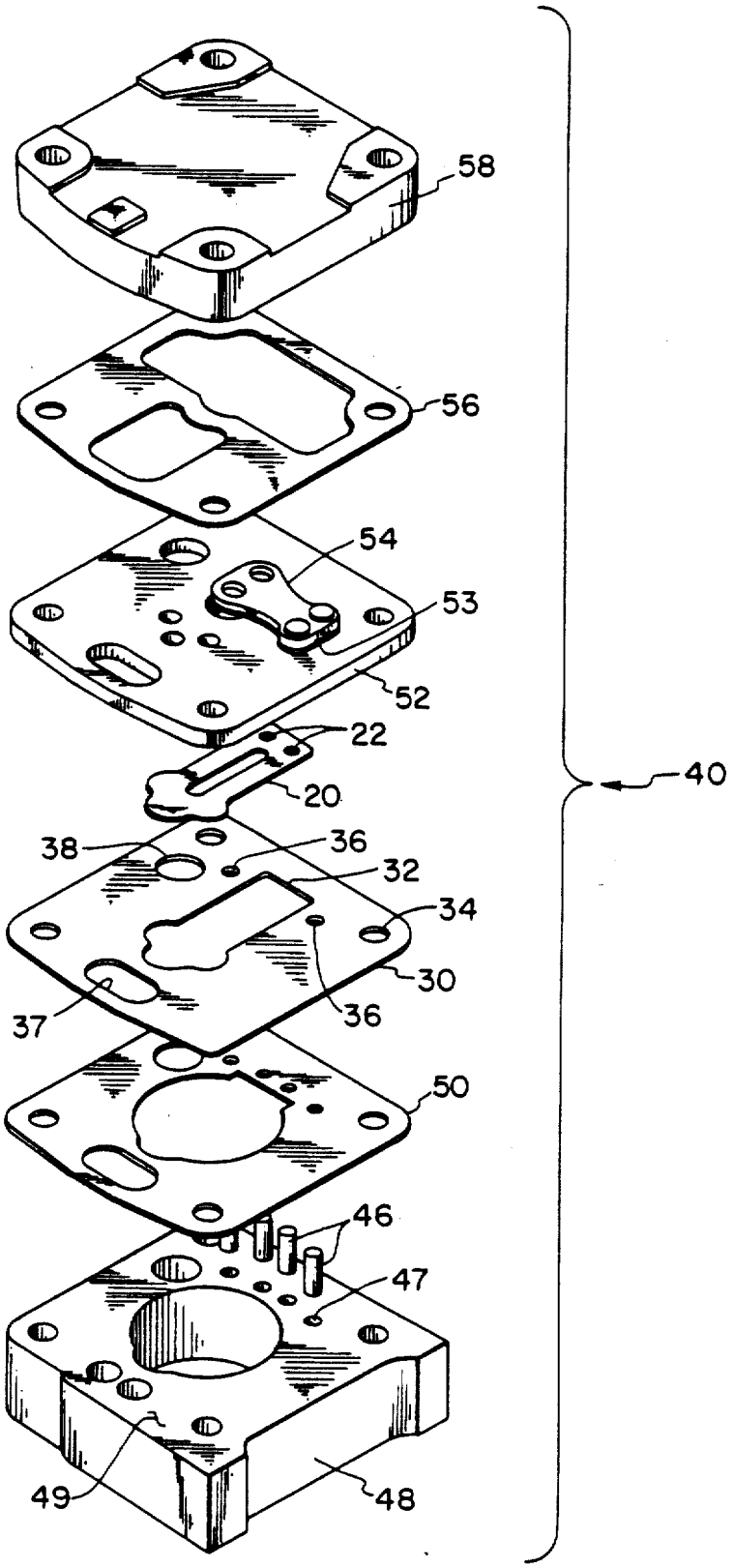
FIG. 5 is an exploded view of embodiment of the valve plate assembly to which the present invention pertains.

As shown in FIG. 5, valve leaf 20 and spacer 30 are incorporated into a valve assembly 40. Valve assembly 40 comprises a crankcase 48 having a crankcase cylinder face 49 and other connected parts discussed herein. Adjacent the crankcase cylinder face 49 is located a valve plate gasket 50. Upon valve plate gasket 50 is spacer 30 of the present invention. The valve leaf 20 is disposed within valve opening 32 of spacer 30. Connector means, specifically locating pins 46, accurately locate valve leaf 20 and spacer 30 within valve assembly 40. Locating pins 46 are disposed in holes 22 in valve leaf 20 and locating holes 36 in spacer 30 to insure proper placement and orientation in valve assembly 40. These locating pins 46 are received into holes 47 in crankcase 48 and holes 51 in valve plate 52, as shown in FIG. 6.

Over the valve leaf 20 and spacer 30 is located a valve plate 52. Upon valve plate 52 is attached a discharge valve 53 and its associated discharge valve retainer 54. Over valve plate 52 is cylinder head gasket 56 between valve plate 52 and cylinder head 58. Cylinder head 58 is attached to crankcase 48 by means of bolts 72 which extend through cylinder head gasket 56, valve plate 52, spacer 30, and valve plate gasket 50. Valve assembly 40, as shown in FIG. 8, is associated with a hermetic reciprocating piston compressor 70.

Compressor 70 includes a housing 74 having an upper portion 76 and a lower portion 78, which are sealingly secured together at seam 80, as by welding. A motor-compressor unit 82 is resiliently mounted within housing 74 by means of a plurality of circumferentially spaced mounting assemblies 84.

Motor-compressor unit 82 includes a crankcase 48 having a crankshaft 88 rotatably received therein, and an electric motor 89 comprising a stator 90 and a rotor 92. Stator 90 is provided with windings 94, which are connected to an external current source by means of electrical leads 95, terminal block 96, and hermetic terminal 98. Rotor 92 has a central aperture 102 provided therein into which is secured crankshaft 88 by an interference fit.

Crankshaft 88 includes an eccentric portion 104 which is received in a closed loop end 106 of connecting rod 108. Connecting rod 108 is also connected to a piston 110 by means of a wrist pin 111. Crankcase 48 includes a cylinder bore 112, defined by cylinder side wall 113, in which piston 110 is reciprocatingly received. Cylinder 50 is covered by valve assembly 40.

Figure 10:
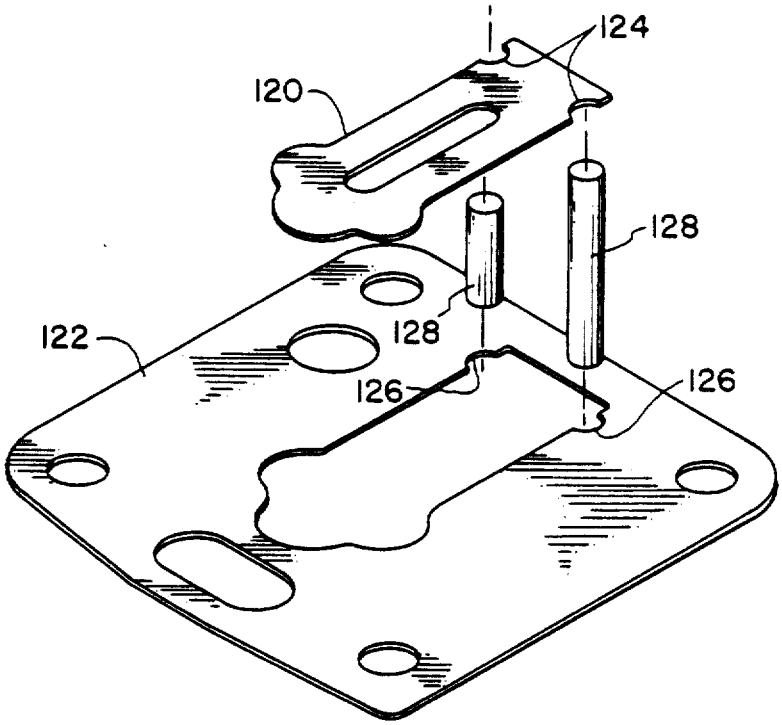
FIG. 10 is an exploded view of an alternative embodiment of the suction valve leaf and spacer of the present invention.

In accordance with an alternative embodiment of the current valve leaf and valve leaf spacer arrangement, FIG. 10 shows an alternative construction. In this case, valve leaf 120 is constructed by stamping out the valve leaf 120 from the inside of valve leaf spacer 122. The shape of valve leaf 120 is substantially the same as the first embodiment, except for generally contiguous semi-circular notches 124 in valve leaf 120 and semi-circular notches 126 in valve leaf spacer 122. These notches permit locating pins 128 to be inserted between the valve leaf 120 and valve leaf spacer 122 during assembly of the valve assembly 40. The notches 124 and 126 allow for proper location and placement of valve leaf 120 within spacer 122. Spacer 122 also has a suction inlet 125 and a discharge outlet 127.

Figure 11:
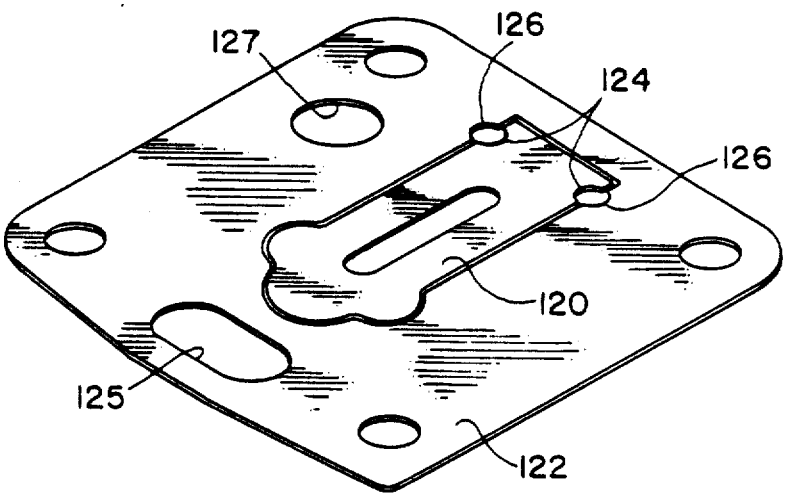
FIG. 11 is a perspective view of the suction valve leaf and spacer after being stamped.

The stamping of this alternative embodiment of the present invention has an additional advantage over the previous embodiment discussed above. The method shown in FIGS. 10 and 11 can use either one stamping tool or two. In the preferred case the tooling would simply stamp the valve spacer 112 and valve leaf 120 out of a strip of metal at the same time. In another case the valve spacer 122 could be stamped first from a strip and then another tool would stamp the valve leaf 120 from the spacer 122. Alternatively the valve leaf 120 could be stamped first then the spacer 122. After the stamping operation is complete, the parts are deburred as above.

This alternative design of the leaf valve 120 permits leaf valve 120 and leaf spacer 122 to be stamp cut from a single blank with common locator pins thus providing more accurate location and requiring less clearance between the parts. This helps increase the capacity of the compressor since reexpansion volume is decreased and the efficiency of the compressor is thereby increased.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of assembling a valve assembly for a reciprocating piston compressor, comprising the steps of:

attaching a valve leaf to a valve plate and crankcase cylinder assembly, said valve plate having a suction opening therein, said valve leaf attached over said suction opening;

attaching a separate valve spacer to said valve plate and cylinder assembly, said separate valve spacer having an encircling edge at least partially encircling said valve leaf; and fastening said valve plate to the compressor crankcase, said valve spacer disposed between said valve plate and said crankcase.

2. The method of claim 1 further comprising fabricating the valve spacer and separate valve leaf by die stamp cutting from at least one strip of metal.

3. The method of claim 2 in which said strip is spring steel and said valve spacer and said valve leaf are stamped out of the same spring steel strip.

4. The method of claim 2 in which said valve spacer and valve leaf are stamped out of separate metal strips.

5. The method of claim 2 in which said valve spacer and valve leaf are stamped out of separate metal strips using separate stamping tools.

6. The method of claim 2 in which said valve spacer and valve leaf are stamped out of separate metal strips using the same stamping tool.

7. The method of claim 2 in which said valve leaf is fabricated from spring steel and said valve spacer is fabricated from standard steel.

8. The method of claim 2 in which said valve spacer is die stamp cut from said metal strip and said valve leaf is die stamp cut from an interior area of said spacer, thereby creating an opening, and said valve leaf is attached to said valve plate and cylinder assembly within said opening.

9. The method of claim 8 in which said die stamp cutting operation also cuts generally contiguous notches in both said valve leaf and said valve spacer, and using pins within the notches to locate said valve leaf and valve spacer relative to each other on said valve plate and crankcase assembly.

10. The method of claim 2 further comprising the step of tumbling said valve leaf and said valve spacer with an abrasive media to deburr edges on said valve leaf and said valve spacer.

11. The method of claim 10 wherein the tumbling of the leafs causes the abrasive material to reduce the outer dimensions of said valve leaf for clearance within said valve spacer.

12. The method of claim 10 wherein the tumbling of the valve spacers causes the abrasive material to enlarge said encircling edge of said valve spacer for increasing the clearance between said valve spacer and said valve leaf.

13. The method of claim 10 in which said tumbling deburrs valve leaf edges and causes clearance between said valve leaf edge and said encircling edge.

14. The method of claim 2 in which said valve spacer completely encircles said valve leaf.

15. The method of claim 2 in which a plurality of pins attach and locate said valve leaf and said valve spacer within said valve plate and cylinder assembly.

16. A method of assembling a valve suction assembly for a reciprocating piston compressor, comprising the steps of:

die stamp cutting a valve spacer and a separate valve leaf from at least one metal strip;

attaching said valve leaf to a valve plate and crankcase cylinder assembly over a suction opening of said valve plate by at least two connecting pins;

attaching said valve spacer to said valve plate and cylinder assembly, said valve leaf located within an opening in said valve spacer, and attaching said valve plate to the compressor crankcase with said valve spacer disposed between said valve plate and said 17. The method of claim 16 in which said valve spacer and valve leaf are stamped out of separate metal strips.

18. The method of claim 16 in which said valve leaf is fabricated using valve steel and said valve spacer is fabricated using standard steel.

19. The method of claim 16 in which said valve spacer is die stamp cut from said metal strip and said valve leaf is die stamp cut from an interior area of said spacer, thereby creating an opening, and said valve leaf is attached to said valve plate and cylinder assembly within said opening.

20. The method of claim 19 in which said die stamp cutting operation also cuts generally contiguous notches in both said valve leaf and said valve spacer, and using pins within the notches to locate said valve leaf and valve spacer relative to each other on said valve plate and crankcase assembly.

* * * * *